United States Patent [19]

Kennedy et al.

[11] Patent Number: 4,588,386

[45] Date of Patent: May 13, 1986

[54] TOY CRASH VEHICLE

[75] Inventors: Melvin R. Kennedy, New York, N.Y.; Dietmar Nagel, Chester, N.J.; Abraham A. Arad, Westport, Conn.

[73] Assignee: Buddy L Corporation, New York, N.Y.

[21] Appl. No.: 707,567

[22] Filed: Mar. 4, 1985

[51] Int. Cl.[4] ..... A63H 17/02

[52] U.S. Cl. ..... 446/6; 446/484

[58] Field of Search ..... 446/4, 5, 6, 431, 462, 446/465

[56] References Cited

U.S. PATENT DOCUMENTS

| | | | |
|---|---|---|---|
| 1,363,891 | 12/1920 | Lovington . | |
| 1,546,431 | 7/1925 | Brandt . | |
| 2,597,094 | 5/1952 | Gutmann | 446/6 |
| 2,757,482 | 8/1956 | Brown et al. . | |
| 2,803,920 | 8/1957 | Salosky . | |
| 3,176,429 | 4/1965 | Brown et al. . | |
| 3,668,804 | 6/1972 | Winston . | |
| 3,859,752 | 1/1975 | Morrison et al. . | |
| 3,959,920 | 6/1976 | Ieda . | |
| 4,114,312 | 9/1978 | Hendry . | |
| 4,295,292 | 10/1981 | Fitzgerald et al. . | |
| 4,508,521 | 4/1985 | Klimpert et al. | 446/4 |

FOREIGN PATENT DOCUMENTS

| | | | |
|---|---|---|---|
| 2067904 | 8/1981 | United Kingdom | 446/6 |

*Primary Examiner*—F. Barry Shay

*Attorney, Agent, or Firm*—Michael Ebert

[57] ABSTRACT

A motorized toy car which upon frontal impact with an obstruction simulates a crash and its consequences. The wheeled car has a chassis, a body thereon defined by a front hood section having a simulated bumper prow, an intermediate cockpit section accommodating a hinged side door, and a rear trunk section having a trunk lid hinged thereon. The intermediate and rear sections are rigid and attached to the chassis, whereas the front section is resilient and free of the chassis. Slidable along the chassis is a sled whose front end is attached to the prow, a coil spring urging the sled to a retracted position in which the front section is deformed to assume a crushed appearance. The side door and the trunk lid are operatively coupled to the sled so that swinging them from their fully open to their closed positions advances the sled against the spring to an extended position which is held by a spring-biased detent and in which the car has a normal appearance. Impact shock releases the detent which frees the sled to return to its retracted position to impart a crushed appearance to the front, the door and oid then being outflung. By again closing the door and lid, the normal appearance of the car is restored.

8 Claims, 9 Drawing Figures

Fig. 1.
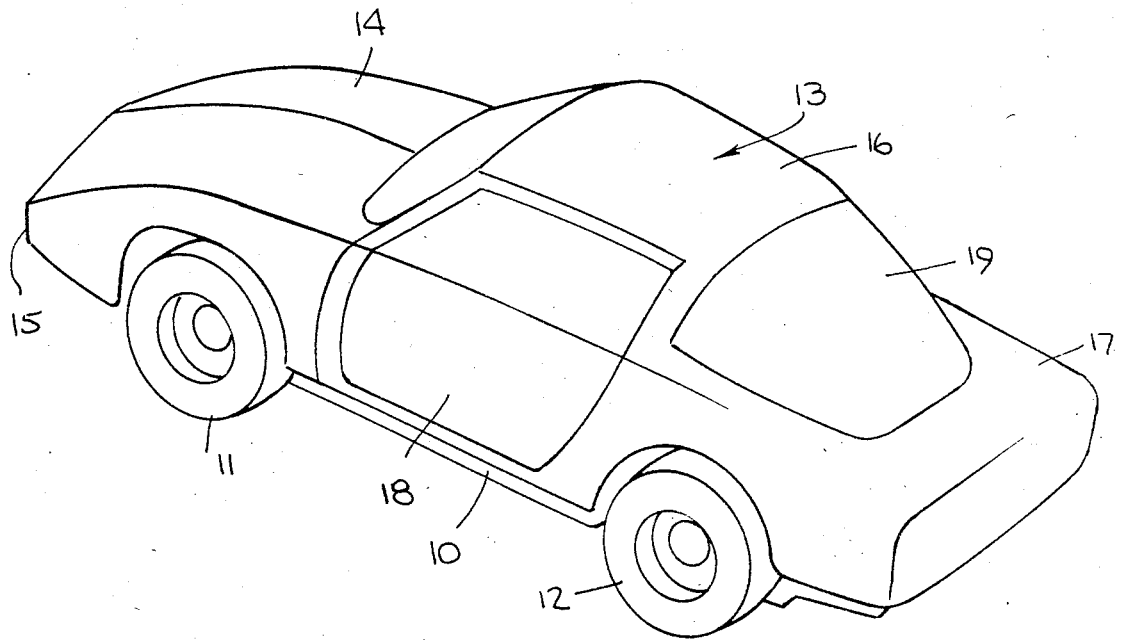
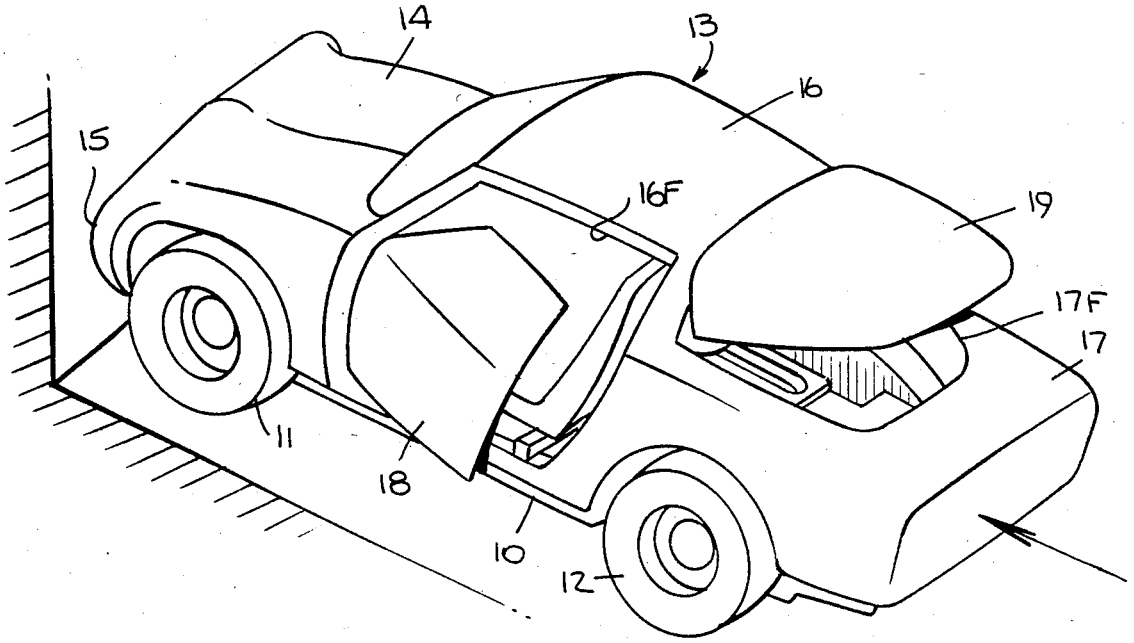
Fig. 2.

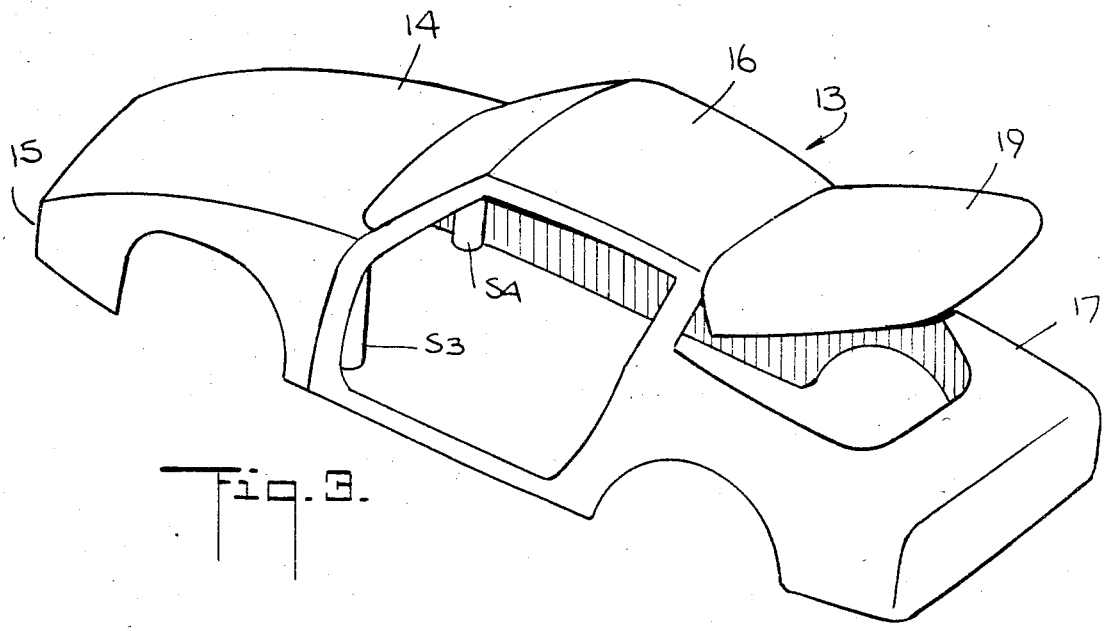
Fig. 3.
Fig. 4.
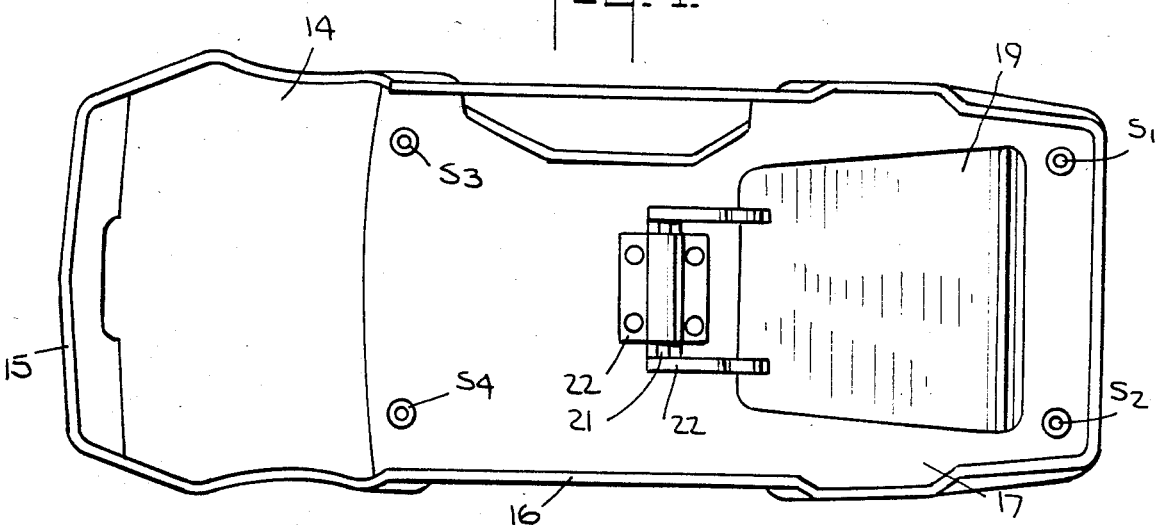
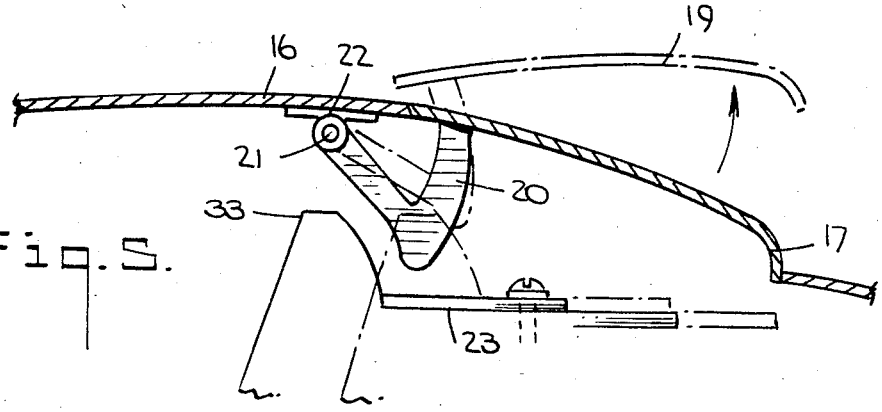
Fig. 5.

TOY CRASH VEHICLE

BACKGROUND OF INVENTION

1. Field of Invention

This invention relates generally to motorized toy vehicles, and in particular to a toy "crash" car which upon frontal impact with a wall or other obstruction simulates a crash and its consequences, the normal appearance of the car being restored simply by closing the side door and the trunk lid, these components being outflung in the crash.

2. Status of the Art

Motorized toy vehicles are popular with children, for in play the child can maneuver the car and thereby imitate an adult activity. Play acting sometimes takes a destructive form in that a typical child not only enjoys operating a toy in its intended manner but he also takes a certain delight in wrecking the toy. The dismantling of a toy does not usually reflect misbehavior on the part of the child, but an expression of natural curiosity. Thus a child who takes a mechanical watch apart is not trying to destroy the watch, but is seeking to learn how it works.

Play constitutes the earliest form of education, for by manipulating toys, by playing house, and by pretending to carry out various adult activities, the child acquires basic skills preparatory to more mature activity. And since in the adult world, automobiles sometimes become involved in accidents and may be wrecked, a child playing with a toy car may attempt to simulate a real car crash and deliberately crash his toy vehicle into a wall or other obstruction just to see what happens.

With a conventional toy car, the player cannot have his cake and eat it, for once this car is crashed and badly damaged, it is no longer operable. In order therefore to provide a player with a toy car that can be crashed without being permanently disabled, so-called "crash" cars have been developed and marketed. In such cars, some of the components such as doors, headlights and bumpers are loosely mounted so that when the vehicle is run into a wall, these components fall off and thereby simulate a crash.

There are a number of practical drawbacks to a "crash" car of this known type. First, because the components necessary to simulate a crash are loosely mounted on the vehicle, they tend to fall off even when the child plays with the car in an ordinary way.

Second, when the vehicle is crashed, the loosely mounted components may scatter in various directions and the child may not be able to retrieve all of the components. Thus when the car is reassembled, one or more of the components may be missing, and with continued use even more may be missing, so that it is no longer possible to restore the vehicle to its normal condition. Moreover, the need to reassemble the car after each crash becomes a tedious task and the child may lose interest in the toy.

SUMMARY OF INVENTION

In view of the foregoing, the main object of this invention is to provide a motorized toy vehicle which upon impact with a wall or other obstruction, simulates a crash without, however, the loss of any component of the vehicle and without the need to reassemble the vehicle in order to restore it to its normal condition.

More particularly, an object of the invention is to provide a toy "crash" car of the above type which in the simulated crash condition imparts a crushed appearance to the front hood section of the car body, the driver's side door and the rear trunk lid being outflung so that the car seems to have been badly damaged.

A significant feature of the invention resides in the fact that the seemingly-damaged car can immediately be restored to its normal undamaged condition simply by closing the side door and trunk lid.

Still another object of the invention is to provide a crash car having a long effective playing life.

Also an object of the invention is to provide a crash car which is of relatively uncomplicated mechanical design and therefore lends itself to low cost mass production.

Briefly stated, these objects are attained in a motorized toy car which upon frontal impact with a wall or other obstruction simulates a crash and its consequences. The wheeled car is provided with a chassis on which a hollow body is mounted, the body being defined by a front hood section having a simulated bumper prow, an intermediate cockpit section accommodating a hinged side door, and a rear trunk section having a trunk lid hinged thereon. The intermediate and rear sections are formed of rigid material and are attached to the chassis, whereas the front section which is formed of resilient material is free of the chassis.

Slidable along the chassis is a sled whose front end is attached to the prow of the front body section, a coil spring urging the sled to a retracted position in which the front section is deformed to assume a crushed appearance. The side door and the trunk lid are operatively coupled to the sled so that when these components are manually swung from their fully open to their closed positions, the sled is then caused to advance against the action of the spring to an extended position which is held by a spring-biased detent. In this extended position, the car assumes its normal appearance in which the front body section is undeformed. Upon impact, the shock thereof releases the detent which frees the sled to return to its retracted position to impart a crushed appearance to the front section of the body, the door and lid then being outflung to simulate a crash. By again closing the door and lid, the normal appearance of the car is restored, thereby making it possible to repeatedly "crash" the toy car.

OUTLINE OF DRAWINGS

For a better understanding of the invention as well as other objects and further features thereof, reference is made to the following detailed description to be read in conjunction with the accompanying drawings, wherein:

FIG. 1 shows, in perspective, a "crash" car in accordance with the invention in its normal condition;

FIG. 2 shows the car in its "crash" condition;

Figure 6:
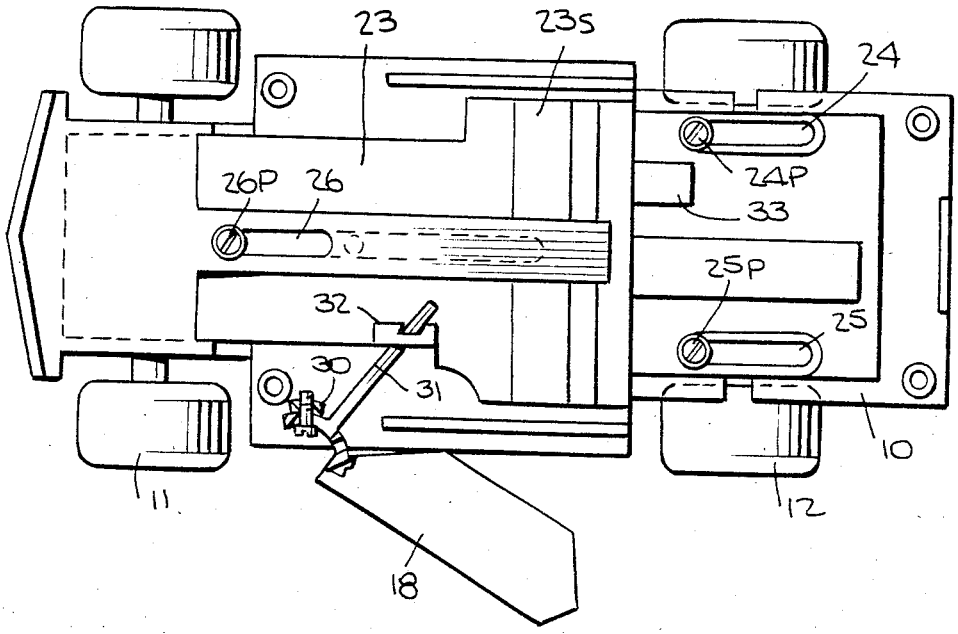
Figure 7:
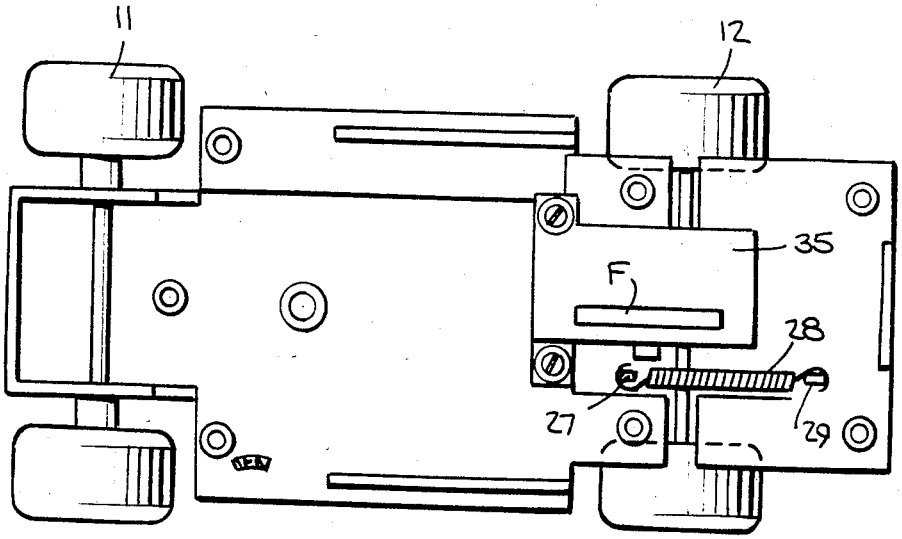
Figure 8:
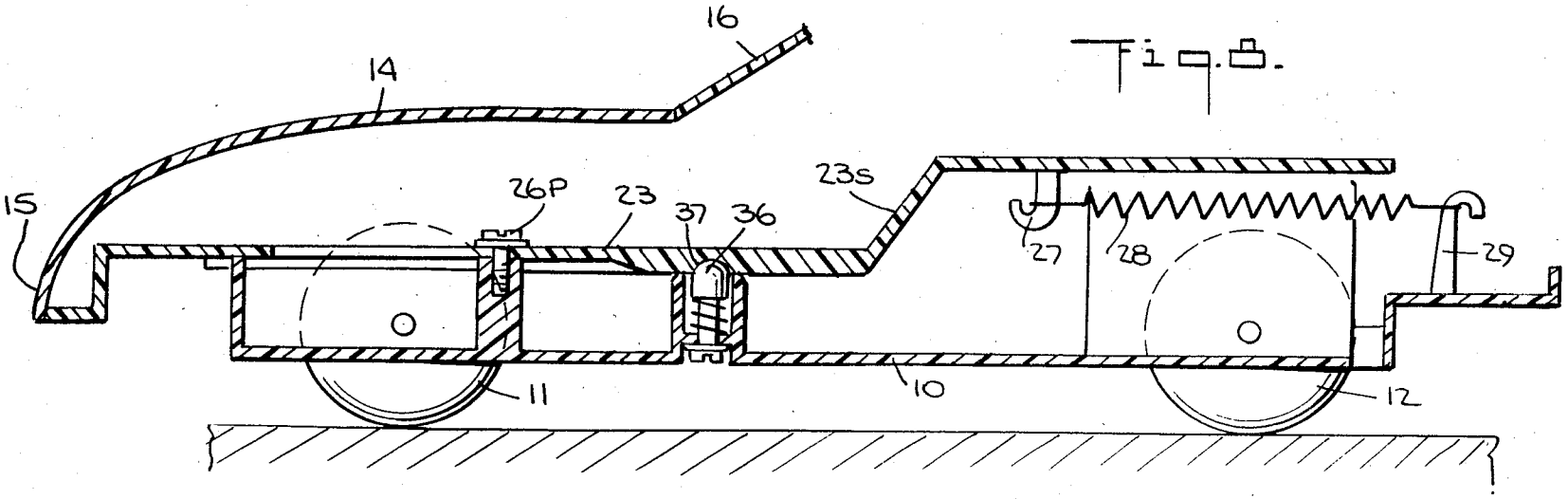

FIG. 3 separately illustrates in side view the body of the car;

FIG. 4 is a bottom view of the body;

FIG. 5 shows the hinging mechanism for the trunk lid;

FIG. 6 is a top view of the sled which is slidable along the chassis of the car;

FIG. 7 is a top view of the chassis with the sled removed;

FIG. 8 illustrates the sled in its retracted position; and

Figure 9:
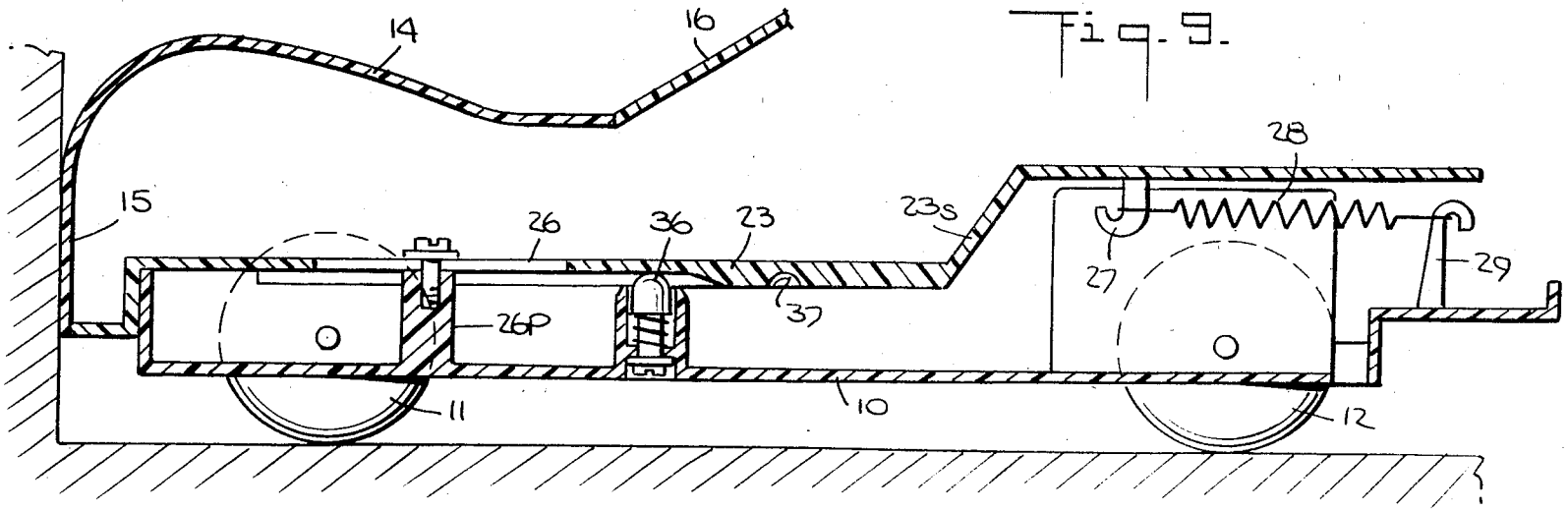

FIG. 9 shows the same sled in its extended position.

DESCRIPTION OF INVENTION

Referring now to FIG. 1, there is shown a "crash" toy car in accordance with the invention in a preferred embodiment which takes the form of a four-wheeled, two-door closed coupe. It is to be understood that the invention may be embodied in various other styles such as a four-door sedan, as long as the vehicle has at least one hinged side door and a hinged trunk lid.

The crash car includes a chassis 10 on which are supported the axles of the front wheels 11 and the rear wheels 12. Mounted on the chassis is a hollow body generally identified by numeral 13, the body having a front engine-hood section 14 provided with a bumper-simulating prow 15. Front section 14 is joined to an intermediate cockpit section 16 which overlies the driver's seat and has a windshield, this section being integral with a rear trunk section 17.

The intermediate and rear sections 16 and 17 are formed of rigid material which may be molded of synthetic plastic, whereas the front section 14 is formed of resilient plastic material. The memory of this resilient material is such that when the front section is subjected to pressure and deformed to assume a crushed appearance as shown in FIG. 2, it recovers its original undeformed appearance when the pressure is released. FIG. 1 shows the car as it normally appears, the door and trunk lid then being closed.

As shown in FIG. 3, intermediate cockpit section 16 is provided at one side with an inset frame 16F which is rigid and is dimensioned to snugly accommodate a door 18 hinged to chassis 10. The rear trunk section 17 is provided with a inset frame 17F which is rigid and dimensioned to snugly accommodate a trunk lid 19 hinged to the trunk section. Neither the door nor the trunk lid is provided with a locking mechanism and when these components are shut, they are lightly held in their respective frames.

The hinging mechanism for the trunk lid, as shown separately in FIGS. 4 and 5, is constituted by a pair of cranks 20 whose upper legs are joined to lid 19 and whose lower legs are connected to the ends of a pivot pin 21. This pin is supported in a bearing plate 22 attached to the underside of the rear trunk section.

Body 13, as shown in FIG. 4, is provided with a pair of spaced mounting columns $S_1$ and $S_2$ in the rear section thereof, and a pair of mounting columns $S_3$ and $S_4$ in the intermediate section thereof. These columns are adapted to threadably receive screws inserted in bores in the chassis so as to secure the intermediate and rear section of the body to the chassis. The resilient front section of the body, which is joined to the rigid intermediate section, is free of the chassis.

Supported for sliding movement along chassis 10 is a sled 23. As shown in FIG. 6, sled 23 is provided adjacent its rear end with a pair of parallel guide slots 24 and 25, and adjacent its front end with a single center guide slot 26. Projecting upwardly into these slots are guide posts 24P, 25P and 26P. These are anchored on the chassis and serve to restrict the axial movement of the sled to the limits imposed by the elongated slots.

The arcuate front end or prow of sled 23 is joined to the bumper prow 15 of the front section 14 of the body, as shown in FIG. 8, the sled formation being such as to define a bucket seat 23S for the driver and a passenger. In an actual model, small figures may be placed on the seats. Chrome-plated metal clips may be used to join the front end of the sled to the prow of the front section, which clips are bent over the bumper prow.

The underside of the sled is provided with a lug 27 that is coupled by an expandable coiled spring 28 to a hook 29 anchored on the chassis 10. Spring 28 urges the sled to its retracted position which is the position shown in FIG. 6 in which the guide posts 24P, 25P and 26P are at the forward end of their associated slots. In the retracted position, the resilient front section 14 of the body is deformed to assume a crushed appearance.

When sled 23 is advanced against the action of spring 28 to assume its extended position in which guide posts 24P, 25P and 26P are at the rear ends of their associated slots, then, as shown in FIG. 9, the front section of the body is undeformed and assumes its normal appearance. This extended position is held by a spring-biased detent 36 which, as shown in FIG. 8, is mounted on chassis 10, the detent being urged into a concave socket 37 on the underside of the sled and is dislodged therefrom by the force of the impact which is applied to the sled.

Door 18 is hinged to chassis 10 by a hinge post 30 as shown in FIG. 6. Cantilevered at an angle from door 18 is arm 31 which extends through a slot in an upstanding stud 32 anchored on sled 23 at a position adjacent front guide slot 26. The arrangement is such that when the sled is in its retracted position, door 18 is fully open; and when the door is manually swung to its closed position, this action causes arm 31 to advance sled 23 toward its extended position, the sled being held at this position by detent 36.

The trunk lid is similarly coupled to the sled so that when the sled is in its retracted position, the lid 19 is fully open; and when the lid is manually swung to its closed position, the action causes the sled to advance toward its extended position. To this end, the lower leg of one of the cranks 20, as shown in FIG. 5, has a cam formation and engages a curved abutment 33 on the sled so that as the trunk lid is being closed, the crank leg pushes the abutment to advance the sled.

As shown in FIG. 7, the rear wheel axle is operatively coupled to an inertia motor 35 of the conventional type used in toy vehicles. The motor has a flywheel F that is coupled by a gear train to the axle, so that when the rear wheels turn, this acts to rotate the flywheel. By repeatedly pushing the vehicle along a running surface in short forward strokes, the player can thereby rev up the flywheel which, because of its inertia, continues to turn. Then when the car is placed on the running surface, the rotating flywheel acts to turn the rear wheel axle to propel the car in the forward direction until the energized motor is exhausted.

To play with the crash car, the player must first close the door and trunk lid so that the sled is in its extended position and the car assumes a normal appearance. Then the motor is revved up and the car released to run in a direction leading to a wall or other obstruction. Upon frontal impact with the wall, the dislodged detent releases the sled and as the sled slides to its retracted position, the door and trunk lid swing out. In the retracted position of the sled, the front section 14 of the body has a crushed appearance and the door and lid are outflung to simulate the effects of a crash. The realistic effect of a crash is enhanced by the inertia motor 35; for upon impact with a wall, the motor of the car is still running, and the car, therefore, seeks to climb up the wall and, in doing so, may overturn.

Instead of an inertia motor, one may use a battery-operated motor coupled to the rear wheel axle, the motor being connected to the battery through an inertial switch having a pivoted actuator arm extending from the chassis which can be manually operated to close the switch. At the inner end of this arm is an accelerator mass which seeks to go forward upon impact, thereby shifting the pivoted arm out of contact with a flexible fixed contact that is arranged to engage the arm when the switch is closed. Thus the motor is disconnected from the battery when the vehicle crashes.

While there has been shown and described preferred embodiments of TOY CRASH VEHICLE in accordance with the invention, it will be appreciated that many changes and modifications may be made therein without, however, departing from the essential spirit thereof. Thus instead of a trunk lid, the car may have another component thereof so hinged to the body that upon impact, this component is dislodged.

We claim:

1. A motorized toy vehicle adapted upon frontal impact with a wall or other obstruction to simulate a crash and its effects, said vehicle comprising:

A. a chassis on which is supported the front and rear wheel axles;

B. a motor mounted on said chassis and coupled to one of said axles to propel said vehicle in the forward direction;

C. a hollow body mounted on said chassis over the motor, said body having a front hood section provided with a bumper prow, an intermediate cockpit section provided with a side door frame, and a rear trunk section, said intermediate and rear sections being formed of rigid material and being attached to said chassis, said front section being formed of resilient material and being free of said chassis;

D. a sled slidable along said chassis, the front end of said sled being attached to said prow, said sled being biased by a spring which urges said sled to a retracted position in which the front section of the body is then deformed to assume a crushed appearance, said sled being advanceable against the action of the spring to an extended position in which the front section is undeformed to assume a normal appearance, the sled being held in the extended position by a releasable spring-biased detent;

E. a hinged door mounted on said vehicle swingable from an open state to a closed state in which it lies within the door frame; and F. means operatively coupling the door to the sled whereby when the door is manually swung from its open to its closed state, this action causes the sled to slide from its retracted to its detented extended position, the detent being released by the shock of said impact, thereby freeing the sled which, as it slides toward its retracted position, swings open the door to cause it to assume an outflung state.

2. A vehicle as set forth in claim 1, wherein said motor is an inertia motor having a flywheel which is operatively coupled to the rear axle and is energized when the vehicle is pushed in short forward strokes by the player across a running surface.

3. A vehicle as set forth in claim 1, in which the motor is an electric motor that is connected through an inertial switch to a battery, which switch is opened by the shock of impact.

4. A vehicle as set forth in claim 1, wherein said body is molded of plastic material, the resilient front section thereof having a memory such that when the sled is restored to it extended position, the deformed front section resumes its normal undeformed appearance.

5. A vehicle as set forth in claim 1, wherein said door is hinged to said chassis, and said means is constituted by an arm cantilevered at an angle from the door and extending through a slot in a stud anchored on the sled.

6. A vehicle as set forth in claim 5, wherein a trunk lid is hinged to the rear body section by a crank having a cam surface which engages an abutment on the sled so that as the lid is being closed, it causes the sled to advance to its extended position.

7. A vehicle as set forth in claim 1, wherein said sled includes a portion which lies under the cockpit section of the body and has a seat formation.

8. A vehicle as set forth in claim 1, wherein said cockpit section has a windshield.

* * * * *